United States Patent [19]

Arimitsu et al.

[11] Patent Number: 4,697,179

[45] Date of Patent: Sep. 29, 1987

[54] INDUCTIVE RADIO CONTROL SYSTEM FOR VEHICLES

[75] Inventors: Hiroshi Arimitsu; Kiyoshi Hatano, both of Kurashiki; Teruyuki Nakanishi, Okayama; Yoshio Yoshimura, Kurashiki; Masaki Urabe, Tokyo; Tsurakazu Honda, Zama, all of Japan

[73] Assignees: Kawasaki Steel Corporation, Kobe; Kabushiki Kaisha Toshiba, Kawasaki, both of Japan

[21] Appl. No.: 716,228

[22] Filed: Mar. 26, 1985

[30] Foreign Application Priority Data

Mar. 28, 1984 [JP] Japan ..... 59-58189
Oct. 5, 1984 [JP] Japan ..... 59-209510

[51] Int. Cl.[4] ..... H04Q 9/00; H04B 7/00; B61L 25/00

[52] U.S. Cl. ..... 340/825.72; 246/63 R; 340/991; 180/168

[58] Field of Search ..... 340/825.72, 825.54, 340/825.69, 941, 991; 180/168; 246/63 R, 187 B, 182, 122 R

[56] References Cited

U.S. PATENT DOCUMENTS

| | | | |
|---|---|---|---|
| 3,760,421 | 9/1973 | Hoyler | 340/825.76 |
| 3,810,099 | 5/1974 | Woods | 340/825.76 |
| 3,888,437 | 6/1975 | Birkin | 246/122 R |
| 4,046,342 | 9/1977 | Buzzard | 246/63 R |
| 4,464,659 | 8/1984 | Bergqvist | 340/825.69 |
| 4,471,356 | 9/1984 | Gidl | 246/122 R |

FOREIGN PATENT DOCUMENTS

| | | |
|---|---|---|
| 52-81833 | 7/1977 | Japan . |
| 54-1508 | 1/1979 | Japan . |
| 57-48108 | 3/1982 | Japan . |

*Primary Examiner*—Donald J. Yusko
*Attorney, Agent, or Firm*—Oblon, Fisher, Spivak, McClelland, & Maier

[57] ABSTRACT

In an inductive radio control system for a vehicle, data transmission between a vehicle which travels along a predetermined route and a ground operation control unit is performed by inductive radio means in such a manner that one of the loop antennas discretely arranged along the predetermined route is coupled to a corresponding transmitter/receiver in accordance with the traveling position of the vehicle. The number of transmitters/receivers is the same as the maximum number of operating vehicles.

5 Claims, 9 Drawing Figures

INDUCTIVE RADIO CONTROL SYSTEM FOR VEHICLES

BACKGROUND OF THE INVENTION

The present invention relates to an inductive radio control system for controlling a plurality of unmanned vehicles driven by an inductive radio apparatus along a predetermined route.

Unmanned vehicles are driven along predetermined routes in factories and the like to transport products. Current positions of vehicles are detected by a ground control unit, and the vehicles are controlled by a computer, a sequence controller or the like in accordance with the scheduled destinations thereof.

A data transmission unit is connected between the ground control unit and each vehicle. Operation instruction data is supplied from the control unit to each vehicle, and vehicle data is sent back from each vehicle to the control unit.

In this case, a conventional data transmission unit comprises an inductive radio apparatus. In the inductive radio apparatus, the transmitting antenna and the receiving antenna are inductively coupled to allow the data transmission/reception therebetween only when they are positioned extremely close to each other. A inductive trolley is arranged along the entire vehicle path to continuously exchange data between the control unit and the vehicles. However, it is difficult to provide the inductive trolley at switching points of the path and intersections with other vehicle paths or with conventional roads. For this reason, the inductive trolley must be divided at points of the path, railroad crossings or the like. When the inductive trolley is divided, a transmitter/receiver is required for each divided inductive trolley. In addition, in order to guarantee continuity of data exchange between the divided inductive trolleys, a proper method of installing the inductive trolley and a switching unit for data exchange between the respective divided inductive trolleys must be provided. When a vehicle path is complex, such a data transmission unit requires a complicated arrangement, resulting in high cost and impairing the reliability of the operation.

In order to detect a current vehicle position in the conventional system described above, a separate position sensor is required, or a travel distance is calculated by the number of revolutions of the wheel from the start point so as to estimate the current vehicle position. However, with the former method, total installation cost is increased. With the latter method, the degree of error is increased with an increase in distance, thereby degrading the precision of detecting a current vechicle position.

In order to solve the above problems, a plurality of loop antennas are separately arranged along the path and communication between the ground control unit and the vehicle is established every time when a vehicle passes a loop antenna. A stop instruction or a run instruction to a next loop antenna is supplied to the vehicle under a given loop antenna. These instructions are stored on a vehicle to control the operation of the vehicle. All the ground loop antennas are connected to a signal receiving means and all the vehicles run while transmitting signals. In this condition, the signals transmitted from the vehicle can be received by one of the ground loop antennas only when the vehicle comes to a position close to the ground loop antenna, causing induction in the ground loop antenna. Therefore, if one ground loop antenna receives a signal, this means that a vehicle has come into close proximity with the ground loop antenna. In this way, the position of each vehicle is detected.

In the data transmission unit described above, transmitters/receivers of an inductive radio apparatus are provided for the respective loop antennas. However, when the number of vehicles is small as compared with the number of loop antennas, numerous transmitters/-receivers are required although the maximum number of actually operated units is the same as the number of vehicles, resulting in a high-cost, redundant system. In addition, in this system, when a failure occurs in a given transmitter/receiver, data transmission cannot be performed between the corresponding loop antenna and a passing vehicle so that the reliability of the system is degraded. Furthermore, when a loop antenna for a faulty transmitter/receiver is located at a stop position of a vehicle, entire system-down of an unmanned operation system occurs.

SUMMARY OF THE INVENTION

It is an object of the present invention to provide a simple inductive radio control system with a simple system configuration and high reliability at low cost.

In order to achieve the above object of the present invention, there is provided an inductive radio control system, wherein line coupling modules are respectively provided for loop antennas, and transmitters/receivers of a number equal to the maximum number of operating vechiles are assigned, by an operation control unit, to the line coupling modules in accordance with the traveling positions of the vehicles.

According to the present invention, the ground unit can be simplified and the number of transmitters/receivers is kept to a minimum, thereby providing an inductive radio control system with high reliability at low cost.

DETAILED DESCRIPTION OF THE PREFERRED EMBODIMENTS

An inductive radio control system according to an embodiment of the present invention will be described with reference to the block diagram of FIG. 1 which illustrates the overall system configuration and the block diagrams of FIGS. 2 to 5 which illustrate the detailed arrangements of the respective components.

In this system, data transmission is performed by the inductive radio apparatus between the transmitters/- receivers and loop antennas separately arranged on the ground by using a signal obtained such that a single tone signal or a plurality of tone signals having frequencies of several handreds are FM-modulated on a carrier wave having a frequency of about 100 kHz. Instruction signals representing the travel direction, stoppage, braking, speed and the like of a vehicle are supplied from the ground unit to the vehicles through the loop antennas. Status signals representing the travel direction, speed, braking, motor operation and the like are transmitted from the vehicles to the ground unit.

Each vehicle has a floating battery powered from a power trolley, a motor driven by the floating battery, a brake mechanism and the like. Each vehicle can be driven for a short distance by only the battery power without being powered from the power trolley.

Figure 1:
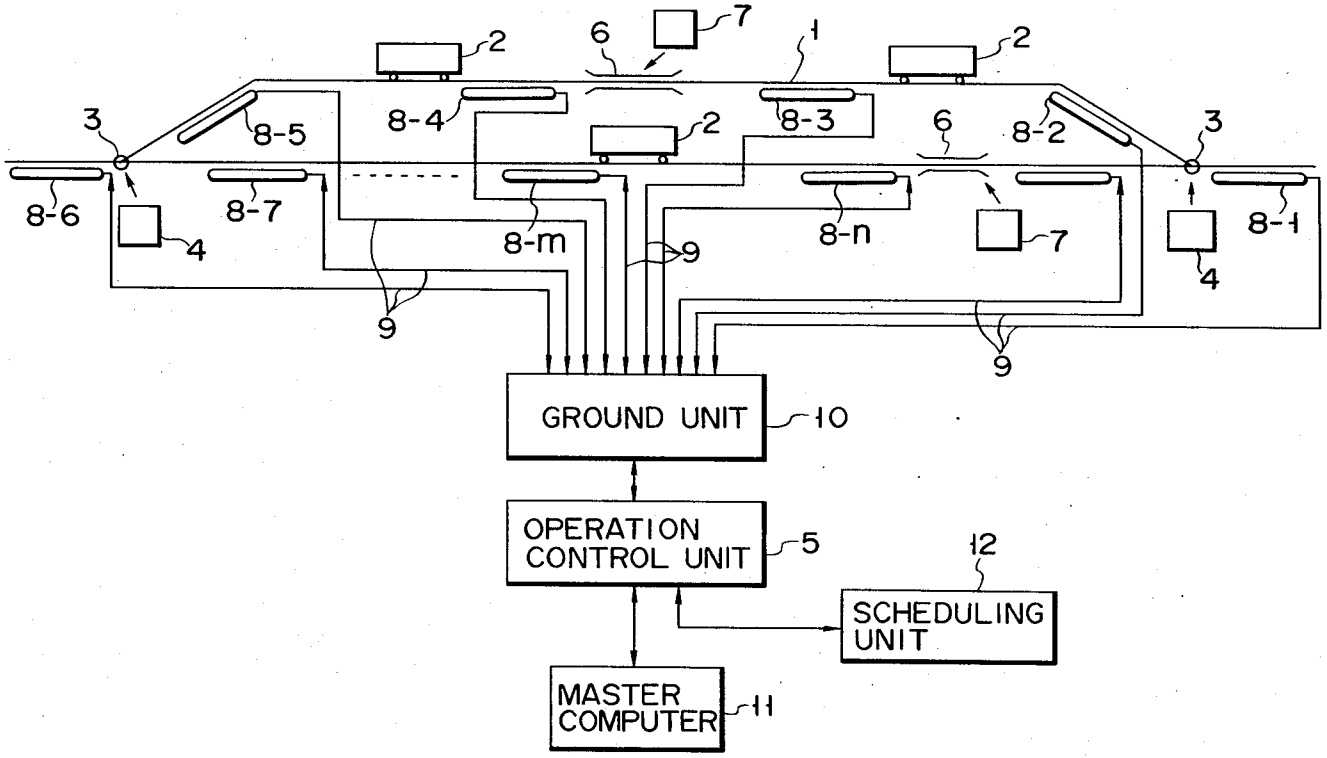
FIG. 1 is a block diagram of an inductive radio control system according to an embodiment of the present invention.

Referring to FIG. 1, a travel path 1 is provided for an entire route, and a plurality of vehicles 2 are driven along the path 1. Points 3 are properly installed along the path 1. Point control units 4 are coupled to the points 3. The point control unit 4 is activated by an operation control unit 5 through a point control system (not shown) in accordance with the operation schedule of the vehicles. Road crossings 6 are properly provided along the path 1 and crossing control units 7 are arranged in the crossings 6. The crossing control units 7 are controlled by the unit 5 through a crossing control system (not shown) in accordance with the operation schedule of the vehicles.

Ground loop antennas 8-1 to **8-*n* are separately arranged along the path 1 to exchange data between the unit 5 and the vehicles 2. With consideration for the operation schedule of the vehicles, the antennas 8-1 to 8-*n* are arranged at the entrances of block section, at the points 3 which are important for safety, at positions before and after the crossings 6, and at stop positions (i.e., work areas) of the vehicles 2. Each of the antennas 8-1 to 8-*n* has such a length that data can be exchanged between the vehicle 2 and the unit 5 even if the vehicle 2 enters the block section at the highest possible speed. Alternatively, it has a length which is the sum of the distance that the vehicle 2 runs until it stops after it has received a stop instruction and the distance that the vehicle 2** needs to receive a restart instruction and to send a normal running condition after it has stopped and the estimated extra distance.

The antennas 8-1 to **8-*n* communicate with the unit 5 through antenna cables 9 and a ground unit 10. The unit is a data processing unit such as a CPU and controls the entire system as will be described in conjuction with the flow charts of FIGS. 6-14 8, in accordance with data (e.g., operation schedule) supplied from a master computer 11** designed for production control.

A work schedule instruction is normally supplied from the computer 11 to the unit 5. The unit 5 controls the operation of the vehicles 2 in accordance with the work schedule.

When the computer 11 is disconnected from the unit 5, the on-line operation is interrupted, or when an interrupt schedule is generated, schedule data is supplied from a scheduling unit 12 to the control unit 5. The scheduling unit 12 may be a computer working as a subsidary unit of the master computer 12.

Figure 2:
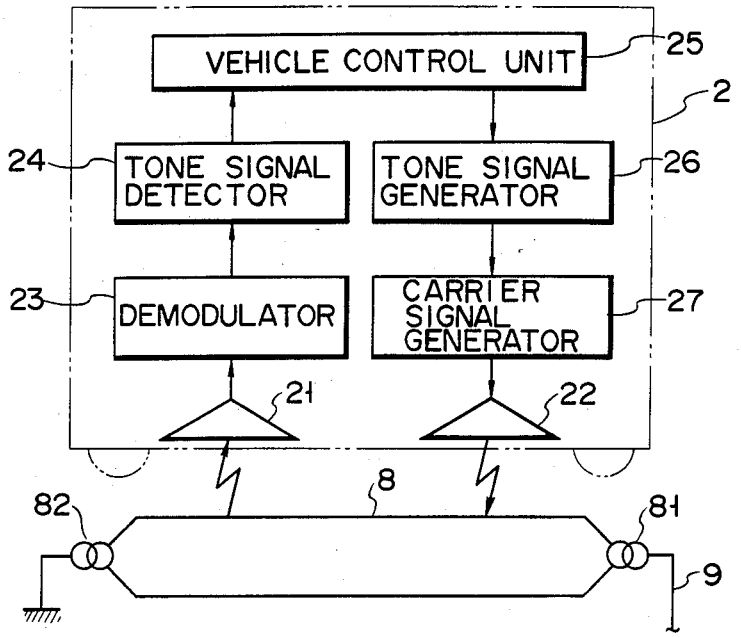
FIG. 2 is a block diagram showing the arrangement of a vehicle shown in FIG. 1.

FIG. 2 is a block diagram showing the arrangement of the trolley 2. The loop antenna 8 arranged along the path 1 is connected to the unit 10 through the corresponding cable 9. A line coupler 81 and a terminating resistor 82 are connected to the ends of the antenna 8, respectively.

A vehicle receiving antenna 21 and a vehicle transmission antenna 22 are mounted on the vehicle to face the loop antenna 8. The carrier wave component of a signal induced by the antenna 21 is removed by a demodulator 23, so that only the modulated wave component is demodulated. The demodulated wave component is supplied to a tone signal detector 24 which detects the contents of the tone signal. A detection result is supplied to a vehicle control unit 25. A switch or the like is controlled in accordance with the content of the tone signal, and the operation of the vehicle is controlled. The operation states of the motor and the brake mechanism and the vehicle speed are detected by proper sensors. Outputs from these sensors are supplied to the unit 25. The unit 25 supplies a selection signal to a tone signal generator 26 so as to select the tone signal represented by the detection state. The generator 26 generates a single tone signal or a plurality of tone signals having a frequency represented by the selection signal. The single tone signal or the plurality of tone signals are supplied to a carrier signal generator 27 to FM-modulate the carrier wave. The FM-modulated carrier wave is sent from the antenna 22 to the antenna 8.

Figure 3:
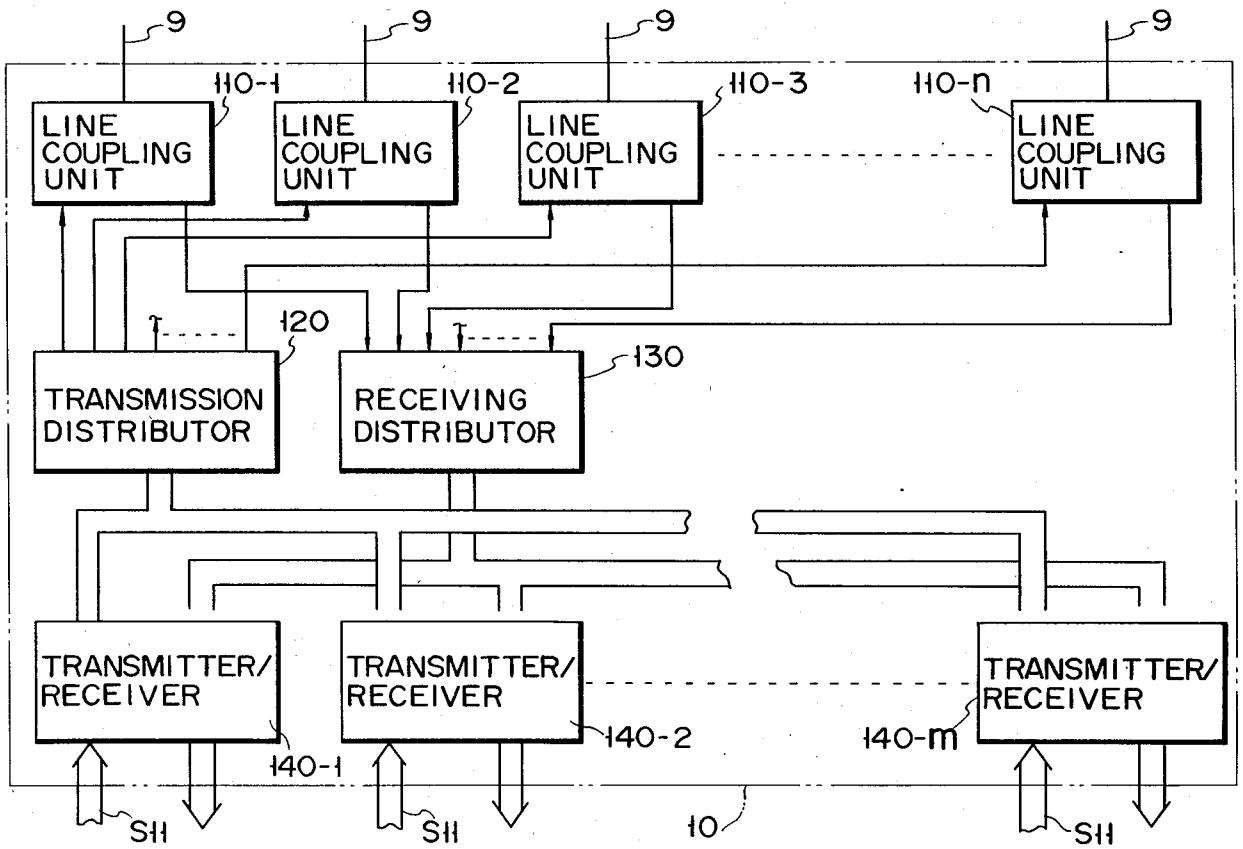
FIG. 3 is a block diagram showing the arrangement of a ground unit shown in FIG. 1.

FIG. 3 is a block diagram showing the detailed arrangement of the ground unit 10. The antennas 8-1 to **8-*n* are connected to line coupling units 110-1 to 110-*n* through the cables 9, respectively. The number of line coupling units is the same as that of loop antennas. Input/output signals with respect to the units 110-1 to 110-*n* are coupled to transmitters/receivers 140-1 to 140-*m* through a transmission distributor 120 and a receiving distributor 130. The number of transmitters/-receivers 140-1 to 140-*m*** is the same as the maximum number of operating vehicles.

Figure 4:
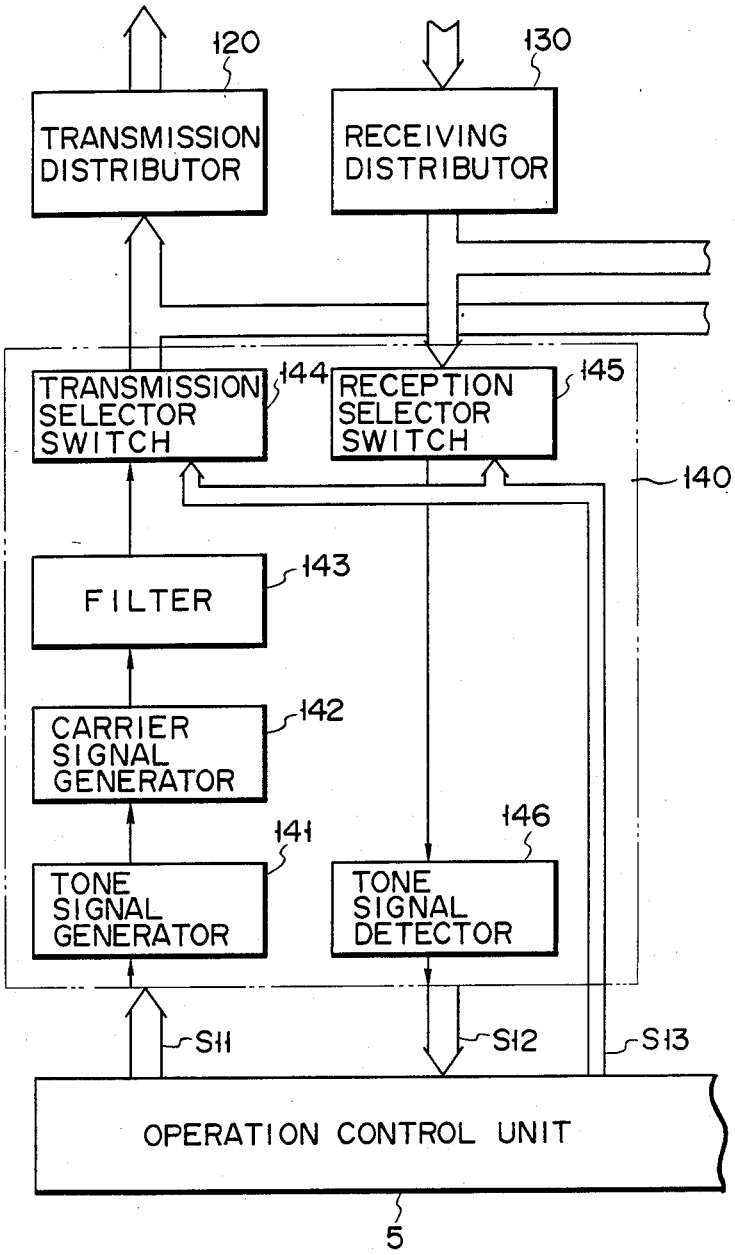
FIG. 4 is a block diagram showing the arrangement of a transmitter/receiver shown in FIG. 3.

FIG. 4 is a block diagram showing the transmitter/-receiver 140. The transmitter/receiver 140 supplies a tone signal to a tone signal generator 141 in accordance with a vehicle control signal S11 generated by the unit 5. The tone signal is supplied to a carrier signal generator 142 and is modulated thereby. The modulated carrier wave is supplied to a transmission selector switch 144 through a filter 143.

The tone signal supplied to a reception selector switch 145 is detected by a tone signal detector 146. A vehicle monitor signal S12 is supplied to the unit 5.

The switches 144 and 145 are controlled by a loop selection signal S13 generated by the unit 5 which selects the loop antenna 8 for sending out the signal S11 and receiving the signal S12. The output from the switch 144 is sent out through the selected antenna 8 via the distributor 120. Similarly, the signal received by the selected antenna 8 is supplied to the tone signal detector 146 through the distributor 130 and the switch 145. Thus, signal selectors may be used as the distributors 120 and 130, respectively.

The vehicle 2 can communicate with one of the antennas 8-1 to **8-*n* only when the vehicle 2 is located above the corresponding loop antenna. When the vehicle 2 is located at a position which is not one of those of the antennas 8-1 to 8-*n*, the signal S11 received from the loop antenna behind the vehicle is stored in the unit 25** and the vehicle moves under the control of the stored signal Sll.

Figure 5:
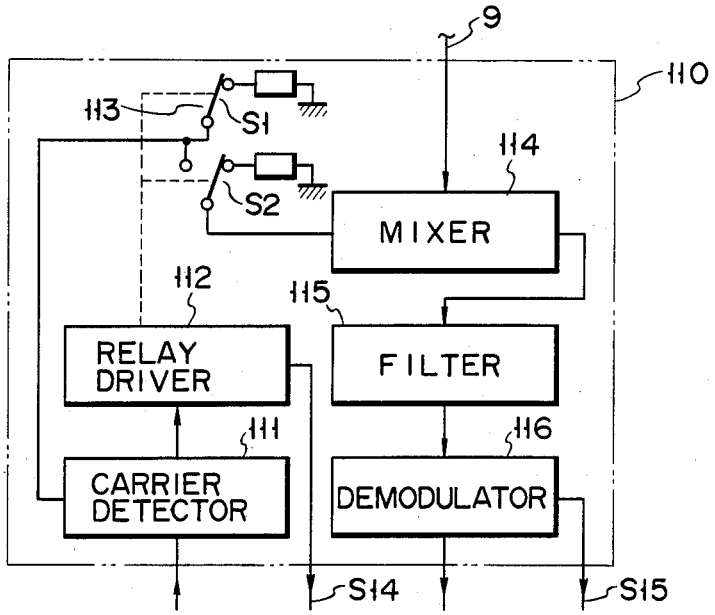
FIG. 5 is a block diagram showing the arrangement of a line coupling unit shown in FIG. 3.

FIG. 5 is a block diagram of a line coupling unit 110. The output from the distributor 120 is supplied to a carrier detector 111. A detection signal from the detector 111 drives a switching relay 113 through a relay driver 112. The output from the distributor 120 is supplied to the corresponding antenna 8 through a mixer 114 and the cable 9 in accordance with the operating states of contacts Sl and S2 of the relay 113. A carrier wave detection signal S14 is generated from the driver 112 to indicate that data transmission is being performed.

The signal received by the antenna 8 is supplied to a filter 115 through the cable 9 and the mixer 114 is demodulated by a demodulator 116. The demodulated signal is supplied to the transmitter/receiver 140 through the distributor 130. The demodulator 116 supplies the carrier wave detection signal S15 to the unit 5 during data reception.

The inductive radio apparatus on the vehicle supplies the signal S12 to the ground system at all times. When the vehicle 2 is located above one of the antennas 8-1 to **8-*n*, the signal S12 is supplied to the unit 5**.

When the vehicle 2 is passing over the antenna 8-1, the signal S12 is supplied from the unit 25 to the demodulator 116 through the generators 26 and 27, the antennas 22 and 8-1, the coupler 81, the mixer 114 and the filter 115 in the order mentioned. When the carrier wave of the signal S12 is detected by the demodulator 116, the signal S15 is supplied from the line coupling unit 110-1 to the unit 5. When the unit 5 receives the signal S15 from the unit 110-1, the unit 5 detects that the vehicle 2 is located above the antenna 8-1 and selects one of the transmitters/receivers 140-1 to **140-*m***.

The unit 5 continuously monitors the operations of the transmitters/receivers 140-1 to **140-*m*. When the unit 5 receives the signal S15 from the unit 110, the unit 5 supplies a loop selection signal S13 to any one of the transmitters/receivers not in use among the transmitters/receivers 140-1 to 140-*m***.

For example, when the transmitter/receiver 140-2 is not in use, the unit 5 supplies the signal S13 to the transmitter/receiver 140-2. The transmitter/receiver 140-2 is coupled to the unit 110-1 through the switches 144 and 145 of the transmitter/receiver 140-2 and the distributors 120 and 130. In this state, data can be exchanged between the vehicle 2 and the unit 5. The unit 5 selects response data (e.g., vehicle number) which the vehicle gives to the ground system in any case. This response data is selected from the signal S12. When the received response data is normal data, the reception system of the transmitter/receiver 140-2 is determined to be normal. Other data included in the signal S12 are also regarded as normal. The data necessary for vehicle control is supplied as the signal S11 from the unit 5 to the transmitter/receiver 140-2.

The signal S11 generated from the ground system is supplied to the unit 110-1 through the switch 144 and the distributor 120. The carrier wave of the signal S11 is detected by the detector 111, and the relay 113 is energized to switch the contacts S1 and S2. Therefore, the signal S11 is transmitted from the ground system to the vehicle through the antenna 8-1.

When the carrier wave is detected by the detector 111, it is determined that the transmission system of the transmitter/receiver 140-2 is normal. The contacts S1 and S2 are operated to establish communication between the vehicle and the ground system.

When transmission data representing, for example, a trolley number, is not sent from the vehicle to the ground system, a failure occurs in this data, or the detector 111 does not detect the carrier wave from the ground system, the signal S13 from the unit 5 is disabled in order to disconnect the transmitter/receiver 140-2. One of the unoccupied transmitters/receivers among the transmitters/receivers 140-1 and 140-3 to **140-*m*** is then selected. The transmission and reception systems of the selected transmitter/receiver are checked to determine whether or not a failure has occurred therein. If this transmitter/receiver is detected to be normal, communication between the vehicle and the ground system is established.

The operating state signal of the relay 113 of each of the units 110-1 to 110-n is supplied to the unit 5. The unit 5 can check this state if it is needed.

Figure 6:
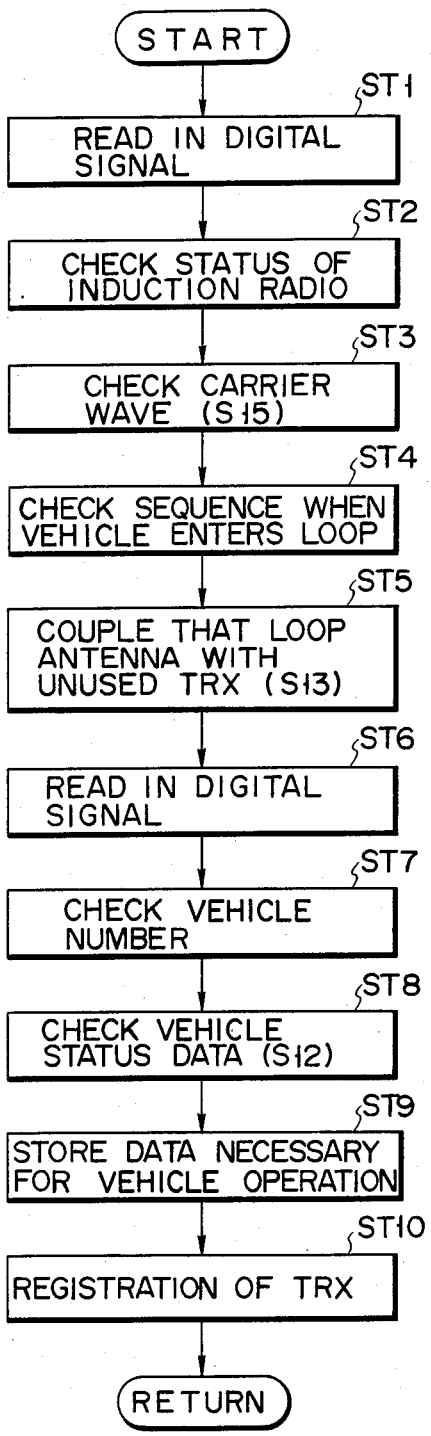
FIGS. 6 to 8 are flow charts for explaining the operation of the operation control unit shown in FIG. 1.
Figure 7:
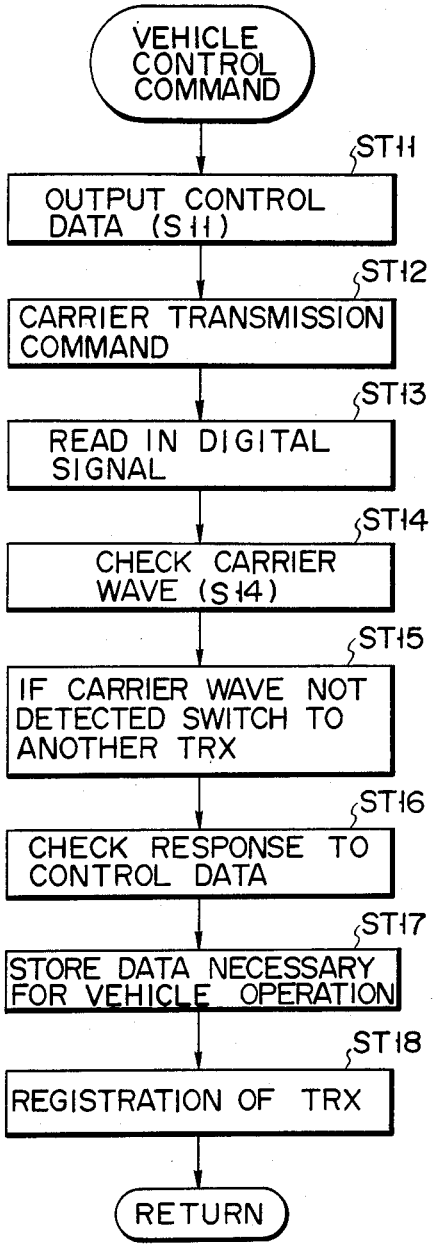
Figure 8:
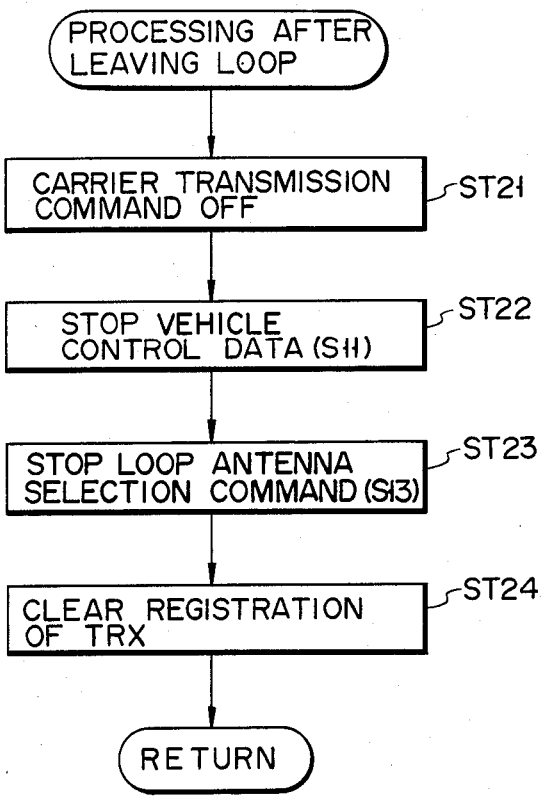

FIGS. 6 to 8 are flow charts for explaining the operation of the unit 5. FIG. 6 is concerned with the routine of data transmission from the vehicle 2 to the unit 5. In ST1, the unit 5 reads in or fetches a digital input. In ST2, the unit 5 checks the status of the inductive radio apparatus. In ST3, the unit 5 detects the carrier wave (S15). In ST4, the unit 5 checks the sequence when the vehicle enters a loop antenna field. When the detection operations in ST2 to ST4 are determined to be normal, the corresponding loop antenna is coupled to an unused transmitter/receiver in accordance with the loop selected signal (S13) in ST5. The unit 5 fetches the digital input in ST6 and checks the vehicle monitor signal (S12) in ST7. The unit 5 checks the vehicle monitor data in ST8 and stores data such as the loop antenna number, and in ST9 the vehicle number and the operating state of the vehicle necessary for the trolley operation are stored. The transmitter/receiver now coupled to the loop antenna is registered as being used in ST10. The flow then returns to ST1. When a failure occurs in any one of ST1 to ST9, a failure processing routine is executed.

FIG. 7 shows a routine for supplying a vehicle control command from the unit 5 to the vehicle. The unit 5 supplies the vehicle control signal (S11) to the vehicle in ST11 and a carrier transmission command to the vehicle in ST12. The unit 5 receives a digital input signal in ST13 and checks the carrier wave detection in ST14. When the carrier wave detection signal (S14) is not detected in ST14, another transmitter/receiver is accessed in ST15. The unit 5 checks the response to control data in ST16. The data necessary for the vehicle operation is then stored in ST17, and in ST18 the selected transmitter/receiver is registered and the flow returns to ST11.

FIG. 8 shows the routine of transmitter/receiver processing when the vehicle 2 leaves the antenna 8. The carrier transmission command, the vehicle control signal (S11) and the loop selection signal (S13) of the loop antenna are disabled in ST21, ST22 and ST23, respectively. In ST24, the registration of the in-use transmitter/receiver is cleared and the flow returns to ST21.

In the above embodiment, when failures occur in the transmission and reception systems of the transmitter/-receiver, another transmitter/receiver is accessed. However, when the transmission function itself is considered, a failure check function of a reception system which detects the vehicle number, a transmission carrier detection function, and a failure check function of the transmission carrier detection of the transmission system, such as the switching relay, need not be provided.

Figure 9:
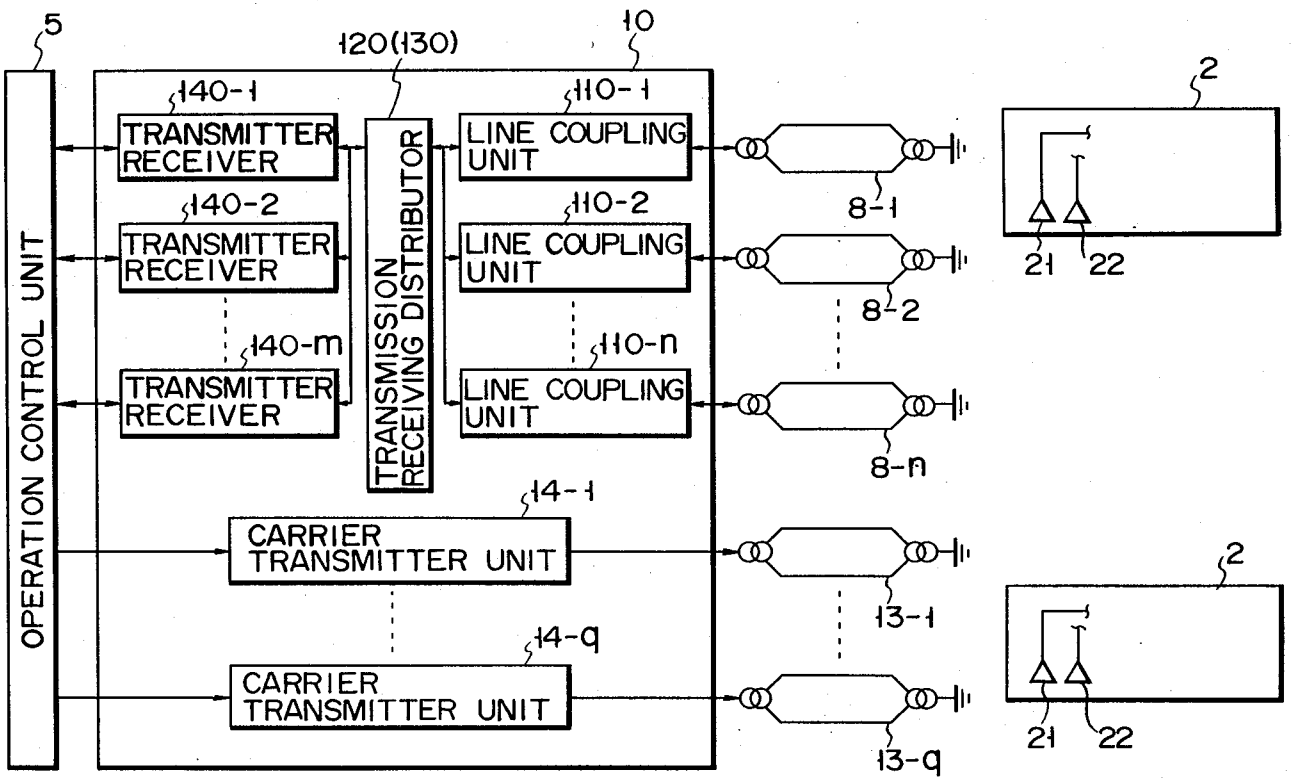
FIG. 9 is a block diagram of an inductive radio control system device according to another embodiment of the present invention.

FIG. 9 is a block diagram of an inductive radio control system according to another embodiment of the present invention. Emergency loop antennas 13-1 to 13-q are arranged in portions of the route where loop antennas are not provided. Carrier transmission units 14-1 to 14-*q* can generate carrier signals in response to a command from an operation control unit 5. When each vehicle receives only the carrier wave which is not modulated with the tone signal, the contents of the control signal are cleared, the motor of the vehicle is stopped, and the brake mechanism is actuated to stop the vehicle. With the above arrangement, the vehicle 2 can be stopped in an emergency situation, thereby further guaranteeing safety.

What is claimed is:

1. An inductive radio control system for vehicles comprising:

a traveling path;

a plurality of traveling means for traveling along the traveling path;

first transmitting/receiving means mounted on the traveling means, the first transmitting/receiving means including means for generating a first carrier signal having a first frequency, first tone generator means for generating a plurality of first tone signals of different frequencies representing different operating states of said traveling means, and means for modulating the first carrier signal by the first tone signals for generating a traveling means monitoring signal;

a plurality of ground loop antenna means separately arranged along the traveling path, each of the ground loop antenna means including means for receiving said traveling means monitoring signal to obtain a carrier detection signal representing that one of said traveling means exists at the ground loop antenna means by detecting said first carrier signal, and means for transmitting a traveling means control signal to the first transmitting-/receiving means;

second transmitting/receiving means including means for generating a second carrier signal of second frequency, second tone generator means for generating a plurality of second tone signals of different frequencies representing different operation states of the traveling means designated in accordance with a predetermined working schedule, and means for modulating the second carrier signal by the second tone signals for generating the traveling means control signal, wherein the number of said second transmitting/receiving means is set the same as the number of said traveling means; and selecting means for selectively coupling the second transmitting/receiving means to one of the ground loop antenna means in accordance with an obtained carrier detection signal.

2. A system according to claim 1, which comprises means for checking said traveling means monitoring signal from said traveling means every time communication between said traveling means and said second transmitting/receiving means is established for data transmission, and means for selecting another second transmitting/receiving means among said second transmitting/receiving means when the traveling means monitoring signal is not received.

3. A system according to claim 1, wherein said selecting means includes means for detecting said second carrier signal when communication between said traveling means and said second transmitting/receiving means is established for data transmission, and means for selecting another second transmitting/receiving means among said second transmitting /receiving means when the traveling means monitoring signal is not detected.

4. A system according to claim 1, wherein means is provided for transmitting to the traveling means said second carrier signal which is not modulated with the second tone signal to be used as a command signal for stopping a traveling means.

5. A system according to claim 4, wherein emergency loop antennae are arranged along portions of the traveling path where said loop antenna means are not arranged, and said second carrier signal is transmitted to said emergency loop antennae.

* * * * *